United States Patent [19]

Sundman

[11] 4,112,587

[45] Sep. 12, 1978

[54] METHOD AND MEANS FOR DRYING A FIBRE MATERIAL CONTAINING CELLULOSE

[75] Inventor: Frey Viking Sundman, Karhula, Finland

[73] Assignee: A. Ahlstrom Osakeyhtio, Finland

[21] Appl. No.: 757,351

[22] Filed: Jan. 6, 1977

[30] Foreign Application Priority Data

Feb. 9, 1976 [FI] Finland ..... 760294

[51] Int. Cl.[2] ..... F26B 7/00

[52] U.S. Cl. ..... 34/12; 34/13; 34/60; 34/62

[58] Field of Search ..... 34/12, 13, 60, 61, 62

[56] References Cited

U.S. PATENT DOCUMENTS

| | | | |
|---|---|---|---|
| 2,996,808 | 8/1961 | Fleissner | 34/60 |
| 3,468,675 | 9/1969 | Potzl | 34/12 |
| 4,024,647 | 5/1977 | Schaefer | 34/12 |

*Primary Examiner*—John J. Camby

*Attorney, Agent, or Firm*—Bucknam and Archer

[57] ABSTRACT

A method and apparatus for drying pulp, wherein the pulp is pre-dried to 60 to 70%, disintegrated and then formed into a layer of fibres on a moving wire which is dried by passing hot air through it to achieve a dryness of 90%. According to a preferred embodiment of the invention the layer of fibres is cooled by air compressed by press rolls after which it is cut into sheets which are piled into bales.

5 Claims, 1 Drawing Figure

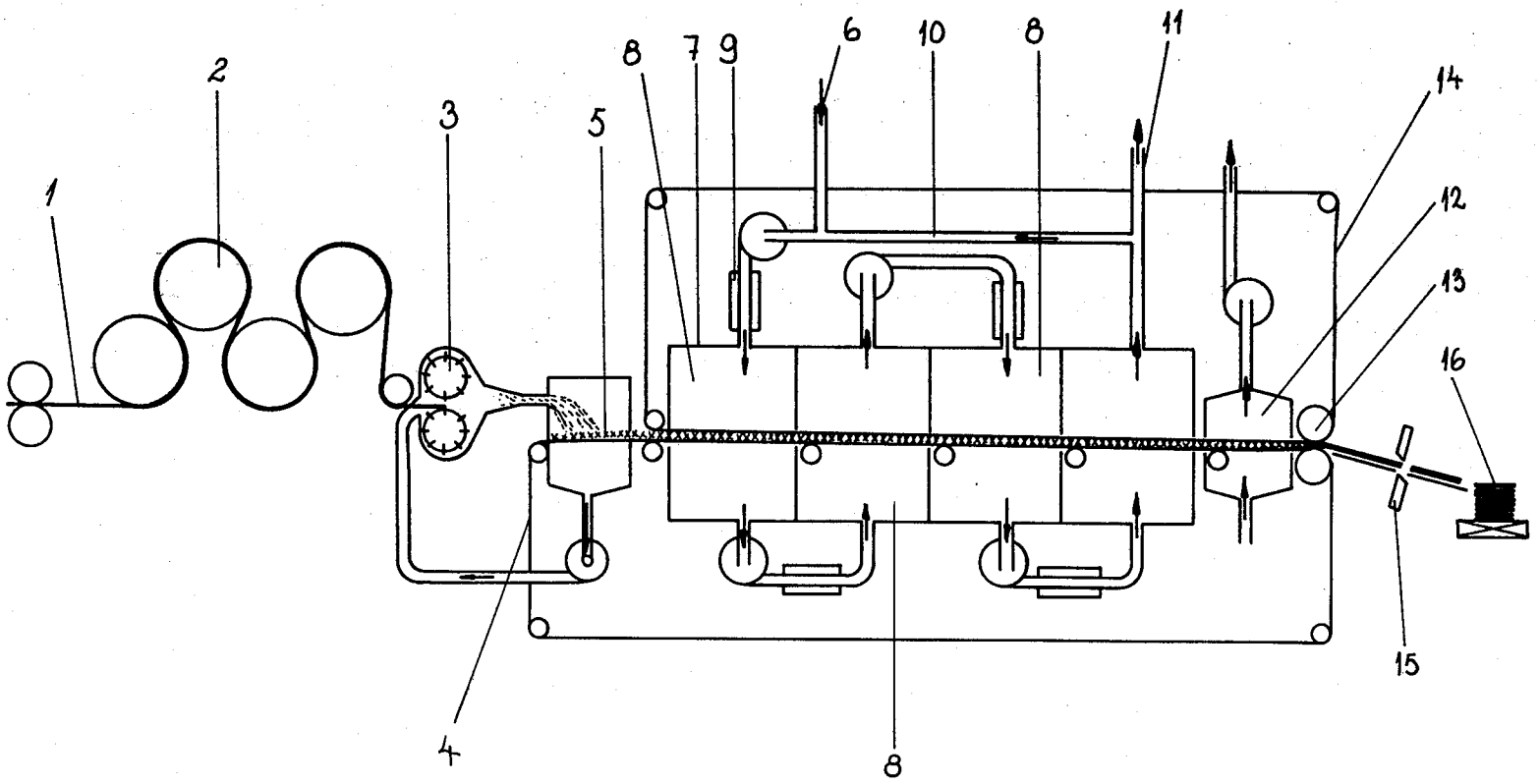
1
2
3
4
5
6
7
8
9
10
11
12
13
14
15
16

METHOD AND MEANS FOR DRYING A FIBRE MATERIAL CONTAINING CELLULOSE

BACKGROUND OF THE INVENTION

1. Field of Invention

The present invention relates to a method and means for drying various fibre materials which are used for making paper, board or the like and in particular for drying wood pulp.

When pulp is produced, water is removed from it by means of pressing and drying until its dryness becomes about 90%. Several different methods are known for drying the pulp, however all have certain disadvantages.

2. Description of the Prior Art

According to one widely used method the pulp is dried in the form of a web, after water has first been removed from it by means of press rolls, the web is conveyed around and pressed against drying cylinders so that the heat required for drying is transferred to the web from the hot metal surface of the cylinders.

Various methods where the drying heat is provided by blowing hot gases against the web are also known.

Common to both of the above mentioned methods, is that the initial phase of the drying is rather rapid, but when the water between the fibres has been removed and the dryness of the web has increased from 40–50% to 60–70%, the drying rate decreases considerably. Therefore in order to reach a dryness of 90% a bulky and expensive dryer is required, which causes high building costs. It is also difficult to defibrate the dried web because of the very strong fibre bondings resulting from the combination of the pressing and subsequent drying to 90%.

Pulp is also dried as flakes, whereby the wet web, from which water has been removed by pressing, is disintegrated and fed into a drying tower together with hot air from an air heater. The initial capital outlay and the space requirement of the flash dryer, as it is called, is smaller than the above mentioned systems, but the power requirement of the process is high. One other drawback of the method is the heterogenity of the dried pulp. When disintegrating the wet web in a shredder, highly compressed spots of fibre clusters result which have a lower drying rate and which are more difficult to defibrate than other parts of the flake.

Is is also well known in the prior art to dry a wet porous web by passing drying air through the web, but the air-through drying method can not be applied economically to webs having a basic weight in the heavier ranges of 500–1500 g/m$^2$, from which water has been removed by pressing, because the web is not sufficiently porous to allow the drying air to pass through it.

OBJECT OF THE INVENTION

It is an object of the present invention to provide an improved method for drying pulp.

SUMMARY OF THE INVENTION

According to the invention water is first removed from the pulp by pressing it with press rolls into the form of a web to a dryness of 40 to 50%, after which the pulp is predried in the form of a web or flakes to a dryness of 60 to 70%, preferably about 65%, after which the pulp is disintegrated and which a layer of fibres is formed from the disintegrated fibre material through which hot air is passed in order to dry it to a dryness of about 90%.

According to a preferred embodiment of the invention the layer of fibres is cooled and then compressed by press rolls whereby a web is formed that holds together and which can be cut into sheets which are piled into bales.

The method is based on the fact that after the predrying when the dryness of the pulp is 60 to 70%, a substantial part of the water between the fibres has been removed. The pulp can easily be disintegrated because it is easy to break the fibre bondings at this dryness and new fibre bondings will not be created. When the fibres which have been dried to a dryness of 90% are cooled, the moisture in the air, enclosed between the fibres, condenses on the surface of the fibres which makes it possible for fibre bondings to develop, and it is therefore possible to form a web which holds together by compressing the layer of fibres with sufficient force.

Owing to the fact that the final drying of the fibres is performed when the fibres form a porous layer in which the fibres are not bonded to each other, the contact surface between the fibres and the drying gas is large and the drying process therefore rapid and efficient. It is possible to use high rates of flow, without causing high pressure drops which means that the power consumption is low. Owing to the fact that there are no hard fibre clusters, the drying result is very homogeneous. An additional advantage of the invention is that the dried pulp sheets can easily be defibrated because the fibre bond strength is very low compared to those which are pressed and dryed in a continuous web form.

BRIEF DESCRIPTION OF THE DRAWING

Further features, objects and advantages of the present invention will be evident from the following description of a preferred embodiment taken in conjunction with the accompanying drawing which shows the equipment needed for carrying out the method schematically.

DESCRIPTION OF THE PREFERRED EMBODIMENT

In the drawing numeral 1 refers to a wet pulp web which has been produced in a manner known per se and from which water has been removed by pressing with press rolls to a dryness of 40 to 50%. The web is predried to a dryness of 60 to 70% by conveying it around and pressing it against drying cylinders 2. The web is then delivered to a disintegrator 3, from which the disintegrated pulp is blown to and distributed over an endless foraminous belt 4, which may be a wire or a felt, on which a porous layer of fibres 5 is formed. The fibres are dried to a dryness of about 90% by hot gas or air 6 which is passed through the layer of fibres in successive sections 8 of a dryer 7. If necessary the supplied air can be heated by heating batteries 9. A portion of the air from the last section can be recirculated through a duct 10 while the rest is removed through a duct 11. The layer of fibres is conveyed through the dryer between the carrying belt 4 and a covering belt 14. The fibres are cooled by passing air through the layer in a cooling chamber 12 and compressed by press rolls 13. The pressed fibre web is cut into sheets by a cutter 15 and piled into bales 16.

EXAMPLES

In the following examples the equipment required for carrying out a method according to the prior art and the method according to the present invention are compared with each other. The comparison is based on a web, having a speed of 100 m/min, a dryness of 45% and a basic weight of 1000 g/m$^2$, which is dried to a dryness of 90%.

EXAMPLE 1.

Cylinder dryer
— evaporating capacity 10 kg/m$^2$h
— drying time 5 min
— number of drying cylinders required 105
— length of dryer section 108 meters

EXAMPLE 2.

Predrying to a dryness of 65% in a cylinder dryer
— evaporating capacity 10 kg/m$^2$h
— drying time 1,7 min
— number of cylinders required 35
— length of dryer section 36 meters Final drying to a dryness of 90% in an air-through dryer
— evaporating capacity 250 kg/m$^2$h when the temperature of the drying air is 250°
— drying time 0,1 min
— length of the air-through dryer 10 meters The combined lengths of the cylinder predryer and the air-through dryer sections provide a reduction of 62 meters compared to the continuous cylinder dryer cited in example 1.

Although the dried layer of fibres in the preferred embodiment disclosed is cooled, compressed in a roll press and cut into sheets from which a bale is formed, it may alternatively be disintegrated and formed to bales of appropriate shape in a baling press.

What is claimed is:

1. A method for drying a fibre material containing cellulose, and preparing a coherent web therefrom which comprises (1) predrying the fibre material in the form of a web or flakes to a dryness of 60 to 70%, (2) disintegrating the pre-dried fibre material whereby a layer of fibres is formed from the disintegrated fibre material; (3) drying said fibre material by passing hot gases through the layer of fibres to a dryness of 90%; (4) cooling said dried fibre material by passing air through the layer of fibres and (5) compressing the fibre layer to obtain a web.

2. A method according to claim 1, wherein the compressed layer of fibres is cut into sheets which are piled into bales.

3. A method according to claim 1, wherein the fibre material is pre-dried by conveying it in the form of a web around drying cylinders.

4. A method according to claim 1, wherein the fibre material is pre-dried in the form of flakes in a flash dryer.

5. An apparatus for drying a wet fiber web to obtain a dried coherent web which comprises press rolls, means for pressing said wet fiber web against said press rolls whereby the web is predried to a dryness of 40–50%, means for conveying said predried web around and against drying cylinders to dry said pulp to a dryness of 60–70%, a disintegrator, means for delivering said web to the disintegrator whereby the pulp is disintegrated, an endless belt connected to said disintegrator, means for conveying said disintegrated pulp to said endless belt whereby a porous layer of fibers is formed on said belt, at least one duct for supplying hot gas through said porous layer whereby the pulp has a dryness of 90%, means for removing the gas, a cooling chamber, means for passing said pulp through the cooling chamber, press means and means for passing said layer of fibers in contact with said pressing means whereby a compressed fiber web is obtained.

* * * * *